US008888984B2

(12) United States Patent
Lee et al.

(10) Patent No.: US 8,888,984 B2
(45) Date of Patent: Nov. 18, 2014

(54) PLATING BATH AND METHOD

(75) Inventors: Inho Lee, Southborough, MA (US); Elissei Iagodkine, Marlborough, MA (US); Yi Qin, Marlborough, MA (US); Yu Luo, Hopewell Junction, NY (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 339 days.

(21) Appl. No.: 13/370,181

(22) Filed: Feb. 9, 2012

(65) Prior Publication Data

US 2013/0206602 A1 Aug. 15, 2013

(51) Int. Cl.

| | |
|---|---|
| ***C25D 3/60*** | (2006.01) |
| ***C25D 7/12*** | (2006.01) |
| ***C25D 3/56*** | (2006.01) |
| ***C25D 3/64*** | (2006.01) |

(52) U.S. Cl.

CPC .. *C25D 3/60* (2013.01); *C25D 3/56* (2013.01); *C25D 7/12* (2013.01); *C25D 3/64* (2013.01)

USPC ..... 205/253; 205/157; 205/238

(58) Field of Classification Search

CPC ..... C25D 3/56; C25D 3/60; C25D 3/64; C25D 7/12

USPC ..... 205/253, 157, 238

See application file for complete search history.

(56) References Cited

U.S. PATENT DOCUMENTS

| | | | | |
|---|---|---|---|---|
| 4,246,077 | A | 1/1981 | Hradeil et al. | |
| 4,582,576 | A | 4/1986 | Opaskar et al. | |
| 4,871,429 | A | 10/1989 | Nobel et al. | |
| 4,891,150 | A * | 1/1990 | Gross et al. | 510/191 |
| 5,911,866 | A | 6/1999 | Oshima | |
| 5,972,875 | A * | 10/1999 | Crutcher et al. | 510/421 |
| 6,099,713 | A | 8/2000 | Yanada et al. | |
| 6,210,556 | B1 | 4/2001 | Toben et al. | |
| 6,607,653 | B1 * | 8/2003 | Tsuji et al. | 205/241 |
| 6,923,875 | B2 | 8/2005 | Ikeda et al. | |
| 6,998,036 | B2 | 2/2006 | Dietterle et al. | |
| 7,122,108 | B2 | 10/2006 | Heber et al. | |
| 7,628,903 | B1 | 12/2009 | Tsuji et al. | |
| 7,968,444 | B2 | 6/2011 | Luo et al. | |
| 2001/0049347 | A1 * | 12/2001 | Robbins et al. | 510/238 |
| 2003/0150743 | A1 | 8/2003 | Obata et al. | |
| 2009/0188807 | A1 | 7/2009 | Egli et al. | |
| 2010/0000873 | A1 * | 1/2010 | Imanari et al. | 205/304 |

FOREIGN PATENT DOCUMENTS

| | | | | |
|---|---|---|---|---|
| EP | 854206 | B1 * | 8/2001 | C25D 3/60 |
| JP | 09-143786 | | 6/1997 | |
| JP | 09143786 | A * | 6/1997 | C25D 3/46 |
| JP | 3012182 | B | 2/2000 | |
| JP | 3632499 | B | 3/2005 | |
| JP | 4186029 | B | 11/2008 | |

* cited by examiner

*Primary Examiner* — Edna Wong
(74) *Attorney, Agent, or Firm* — S. Matthew Cairns

(57) ABSTRACT

Tin-silver alloy electroplating baths having certain amine-oxide surfactants and methods of electrodepositing a tin-silver-containing layer using these baths are disclosed. Such electroplating baths are useful to provide tin-silver solder deposits having reduced void formation and improved within-die uniformity.

12 Claims, No Drawings

PLATING BATH AND METHOD

The present invention relates generally to the field of electrolytic metal plating. In particular, the present invention relates to the field of electrolytic tin-alloy plating.

Tin-alloys are commercially important, particularly in the electronics industry where they are often used as solders. The use of tin-lead, once the most common tin-alloy solder, has declined due to the increasing restrictions on lead. Tin-silver, tin-copper, tin-bismuth, tin-silver-copper, and other lead-free tin-alloys, are common replacements for tin-lead solders. These solders are often deposited on a substrate using a plating bath. Electroplating is a common way to deposit a lead-free tin-alloy on a substrate.

Methods for electroplating articles with metal coatings generally involve passing a current between two electrodes in a plating solution where one of the electrodes is the article to be plated. A typical tin-alloy plating solution comprises dissolved tin (divalent tin), one or more dissolved alloying metals, such as silver or copper, an acid electrolyte such as methanesulfonic acid in an amount sufficient to impart conductivity to the bath, and proprietary additives to improve the uniformity of the plating and the quality of the metal deposit. Such additives include complexers, surfactants, and grain refiners, among others.

U.S. Pat. No. 5,911,866 discloses an acidic tin-silver alloy electroplating bath containing a compound chosen from aromatic thiol compounds and aromatic sulfide compounds. This patent does not disclose the use of alkoxylated amine-oxide surfactants. Such aromatic compounds do not provide sufficient performance in tin-silver electroplating baths to meet the demanding criteria for solder performance in many applications.

U.S. Pat. No. 7,628,903 discloses conventional silver and silver-alloy electroplating baths containing certain sulfide compounds. This patent purports that these electroplating baths have good stability. However, it has been found that upon extended storage or long-term use, such sulfide compounds polymerize or decompose, resulting in precipitation of silver from the electroplating bath.

There remains a need to tin-alloy electroplating baths, particularly tin-silver alloy electroplating baths, that have sufficient stability upon storage and long-term use and provide tin-silver alloy deposits that meet solder performance criteria in various applications.

The present invention provides an electroplating composition comprising: a water-soluble source of divalent tin ions; a water-soluble source of silver ions; water; acid electrolyte; and an alkoxylated amine oxide surfactant. Such electroplating composition may further include one or more adjuvants.

Also provided by the present invention is a method of depositing a tin-silver alloy on a substrate comprising: contacting a substrate with an electroplating composition comprising: a water-soluble source of divalent tin ions; a water-soluble source of silver ions; water; acid electrolyte; and an alkoxylated amine oxide surfactant; and applying a potential for a period of time to deposit a tin-silver-containing layer on the substrate.

As used throughout this specification, the following abbreviations shall have the following meanings, unless the context clearly indicates otherwise: ASD=A/dm$^2$=amperes per square decimeter; ° C.=degrees Centigrade; g=gram; L=liter; Å=angstroms; μm=microns=micrometers; mm=millimeters; min=minutes; DI=deionized; and mL=milliliter. All amounts are percent by weight ("wt %") and all ratios are molar ratios, unless otherwise noted. All numerical ranges are inclusive and combinable in any order, except where it is clear that such numerical ranges are constrained to add up to 100%.

As used throughout this specification, the term "plating" refers to metal electroplating. "Deposition" and "plating" are used interchangeably throughout this specification. "Halide" refers to chloride, bromide, iodide and fluoride. The articles "a" and "an" refer to the singular and the plural.

It has been surprisingly found that the use of an alkoxylated amine oxide surfactant in a tin-silver electroplating bath provides improved within-die uniformity as compared to conventional non-ionic surfactants. It has been further found that the combination of an amine oxide surfactant and a mercapto-substituted nitrogen-containing heterocyclic ring compound in the present tin-silver electroplating baths provides tin-silver deposits that are substantially-free of voids and have improved within-die uniformity, as compared with conventional tin-silver electroplating baths.

Any substrate upon which a tin-silver-containing alloy can be electroplated is useful in the present invention. Such substrates include, but are not limited to, electronic devices such as printed wiring boards, lead frames, interconnects and semiconductive substrates. As used herein, the term "semiconductive substrates" includes any substrate having one or more semiconductor layers or structures which include active or operable portions of semiconductor devices. The term "semiconductor substrate" is defined to mean any construction comprising semiconductive material, including but not limited to bulk semiconductive material such as a semiconductive wafer, either alone or in assemblies comprising other materials thereon, and semiconductive material layers, either alone or in assemblies comprising other materials. A semiconductor device refers to a semiconductor substrate upon which at least one microelectronic device has been or is being batch fabricated. As used herein, the term "wafer" is intended to encompass "a substrate," "a semiconductor substrate," "a semiconductor device," and various packages for various levels of interconnection, including a single-chip wafer, multiple-chip wafer, packages for various levels, or other assemblies requiring solder connections. Particularly suitable substrates are patterned wafers, such as patterned silicon wafers and patterned gallium-arsenide wafers. Such wafers may be any suitable size. Preferred wafer diameters are 200 mm to 300 mm, although wafers having smaller and larger diameters may be electroplated according to the present invention.

The tin-silver alloy electroplating baths of the present invention comprise a water-soluble source of divalent tin ions; a water-soluble source of silver ions; water; acid electrolyte; and an alkoxylated amine oxide surfactant. Optionally, such electroplating baths further comprise one or more adjuvants. It is preferred that the present tin-silver alloy electroplating baths comprise a water-soluble source of divalent tin ions; a water-soluble source of silver ions; water; acid electrolyte; an alkoxylated amine oxide surfactant; and a mercapto-substituted nitrogen-containing heterocyclic ring compound.

Any water-soluble divalent tin salt may suitably be used in the present invention. Examples of such tin compounds include, but are not limited to, tin oxide and salts such as tin halides, tin sulfates, tin alkane sulfonate such as tin methane sulfonate, tin aryl sulfonate such as tin phenyl sulfonate, tin phenol sulfonate, and tin toluene sulfonate, tin alkanol sulfonate, and the like. When tin halide is used, it is preferred that the halide is chloride. It is preferred that the tin compound is tin oxide, tin sulfate, tin chloride, tin alkane sulfonate or tin aryl sulfonate. More preferably, the tin salt is the stannous salt of methanesulfonic acid, ethanesulfonic acid, propanesulfonic acid, 2-hydroxyethane-1-sulfonic acid, 2-hydroxypropane-1-sulfonic acid, or 1-hydroxypropane-2-sulfonic acid, and even more preferably tin methanesulfonate. Mixtures of tin salts may be used. The tin compounds useful in the present invention are generally commercially available from a variety of sources and may be used without further purification. Alternatively, the tin compounds useful in the present invention may be prepared by methods known in the literature.

The amount of water-soluble tin ion source used in the present electroplating baths may vary over a wide range. Suitable amounts of water-soluble tin ion source are from 5 to 100 g/L, preferably from 5 to 85 g/L and more preferably from 10 to 85 g/L. Suitable amounts of tin ion source may vary by application. For example, from 5 to 25 g/L of tin ion source may be used for low speed processes and from 30 to 85 g/L for high-speed processes.

Any water-soluble source of silver ions may be used in the present invention. Examples of suitable silver compounds include, but are not limited to, silver oxide, silver nitrate, silver methane sulfonate, silver iodide, silver chloride, and silver sulfate. Silver oxide and silver methane sulfonate are preferred. Mixtures of water-soluble silver compounds may be used.

A wide range of amounts of water-soluble silver compound may be used in the present electroplating baths, depending on the amount of silver desired in the tin-silver alloy. The choice of such an amount of silver compound is within the ability of one skilled in the art. When tin-silver alloys having ≤10 wt % silver, such as from 0.1 to 10 wt %, are desired, exemplary amounts of silver compound in the present electroplating baths may range from 0.05 to 10 g/L. Preferably, the amount of silver compound is from 0.1 to 10 g/L, more preferably from 0.1 to 8 g/L, and even more preferably from 0.1 to 5 g/L. For high speed processes, a suitable amount of silver compound is from 0.5 to 8 g/L.

Any acidic electrolyte that is solution-soluble and does not otherwise adversely affect the electrolyte composition may be used in the present invention. Suitable acidic electrolytes include, but are not limited to: alkanesulfonic acids, such as methanesulfonic acid, ethanesulfonic acid and propanesulfonic acid; arylsulfonic acids such as phenylsulfonic acid, toluenesulfonic acid, phenolsulfonic acid, and cresolsulfonic acid; sulfuric acid; sulfamic acid; and mineral acids such as, hydrochloric acid, hydrobromic acid and fluoroboric acid. Alkanesulfonic acids and arylsulfonic acids are preferred acid electrolytes, and alkanesulfonic acids are more preferred. Methanesulfonic acid is particularly preferred. Mixtures of acidic electrolytes are particularly useful, such as, but not limited to, mixtures of alkane sulfonic acids and sulfuric acid. Thus, more than one acidic electrolyte may be used advantageously in the present invention. The acidic electrolytes useful in the present invention are generally commercially available and may be used without further purification. Alternatively, the acidic electrolytes may be prepared by methods known in the literature. Typically, the amount of acidic electrolyte in the present electroplating baths is in the range of 10 to 400 g/L, preferably from 100 to 400 g/L, and more preferably from 150 to 350 g/L.

The present electroplating baths contain one or more alkoxylated amine oxide surfactants. While a variety of amine-oxide surfactants are known, it is preferred that low-foaming amine oxide surfactants are used. Preferred alkoxylated amine oxide surfactants have viscosities of less than 5000 centipoise ("cps") measured using a Brookfield LVT Viscometer with a #2 spindle. Typically, this viscosity is determined at ambient temperature (approximately 20° C.). Preferred alkoxylated amine oxides have the formula:

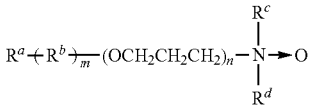

wherein $R^a$ is selected from a $(C_6\text{-}C_{22})$alkyl group and a substituted $(C_7\text{-}C_{22})$aryl group; $R^b$ is an alkoxylated unit; m is 0 to 7 and represents the number of moles of $R^b$; n is 0 or 1; and $R^c$ and $R^d$ are each at least one alkoxylated unit and the total number of alkoxylated units present in $R^c$ and $R^d$ is from 3 to 30. Alkoxylated units refer to the individual alkylene oxide units added to the amine Suitable alkylene oxide units include ethyleneoxy, propyleneoxy, butyleneoxy, and mixtures thereof, including isomers. $R^a$ is preferably selected from a $(C_6\text{-}C_{22})$alkyl group. $R^b$ may be selected from various alkylene oxide units, such as styrene oxide, ethyleneoxy, propyleneoxy, butyleneoxy and mixtures thereof. It is preferred that the alkoxylated units for $R^b$ are selected from ethyleneoxy, propyleneoxy, butyleneoxy and mixtures thereof. Preferred alkoxylated units for $R^c$ and $R^d$ include ethyleneoxy, propyleneoxy, and butyleneoxy units including mixtures thereof. It is preferred that $R^c$ and $R^d$ are each selected from ethyleneoxy units propyleneoxy units, and mixtures thereof. More preferably, $R^c$ and $R^d$ are each ethyleneoxy units. Preferred amine oxide surfactants include from 5 to 20 moles of alkoxylated units present in $R^c$ and $R^d$. More preferably, $R^c$ and $R^d$ include from 5 to 15 moles of alkoxylated units. Particularly suitable amine oxide surfactants are those wherein each of $R^c$ and $R^d$ are composed of 3.5 to 10 moles of alkoxylated units selected from ethyleneoxy units, propyleneoxy units, and mixtures thereof. Preferably, m=0. It is preferred that n=1. More preferred are amine oxides where m=0 and n=1, and more preferably $R^a$ is $(C_6\text{-}C_{22})$alkyl group. Yet more preferred amine oxides are those where m=0, n=1, $R^a$ is a $(C_6\text{-}C_{22})$alkyl group, and $R^c$ and $R^d$ are each ethyleneoxy units.

Alkoxylated amine oxide surfactants are generally commercially available or may be prepared following known procedures, such as those described in U.S. Pat. No. 5,972,875. Preferred amine oxide surfactants are those sold under the Tomamine brand, available from Air Products, such as those having the designation AO-14-2, AO-728, AO-405 and AO-455. The amine oxide surfactants are used in the present electroplating baths in an amount of from 0.1 to 50 g/L, preferably from 0.1 to 25 g/L, more preferably from 0.5 to 25 g/L, yet more preferably from 1 to 20 g/L, and still more preferably from 5 to 20 g/L.

In addition to the components described above, the present electroplating baths may optionally include one or more "adjuvants." Adjuvants, as used herein, are additives or compounds that may be added to the composition in addition to the primary ingredients (tin and silver compounds, acidic electrolyte, water, amine oxide surfactant), which contribute to the effectiveness of the primary ingredients. Examples of suitable adjuvants include, but are not limited to, mercapto-substituted nitrogen-containing heterocyclic ring compounds, brighteners, antioxidants, additional surfactants, grain refiners, conductivity acids and their salts, and mixtures thereof. The list of adjuvants is not exhaustive and any compound or element that improves the effectiveness of tin-silver deposition may be employed to practice the present invention. Such adjuvants may be employed in conventional amounts.

Electroplating baths of the present invention optionally contain one or more mercapto-substituted nitrogen-containing heterocyclic ring compounds, and preferably do contain such a mercapto-substituted nitrogen-containing heterocyclic ring compound. The choice of such mercapto-substituted nitrogen-containing heterocyclic ring compound is not limited, provided that it has one or more mercapto (thiol) substituents. Preferably, the mercapto-substituted nitrogen-containing heterocyclic ring compound has from 1 to 5 mercapto substituents, more preferably from 1 to 4, yet more preferably from 1 to 3, and even more preferably 1 or 2 mercapto-substituents. The mercapto-substituted nitrogen-containing heterocyclic ring compound preferably comprises from 1 to 3 nitrogen-containing heterocyclic rings. Such nitrogen-containing heterocyclic rings contain from 1 to 4 nitrogen atoms, and preferably from 3 to 4 nitrogen atoms. Suitable mercapto-substituted nitrogen-containing heterocyclic ring compounds include, without limitation, mercapto-substituted nitrogen-containing heterocyclic rings chosen from: pyridine, pyrrole, imidazole, benzimidazole, purine, thiazoline, tetrazole, triazole, benzotriazole, thiadiazole, and pyrimidine. Preferably, the nitrogen-heterocyclic ring comprises a 5- or 6-membered ring, more preferably the nitrogen-heterocyclic ring is chosen from triazole and tetrazole, and even more preferably the nitrogen-heterocyclic ring is a triazole. Optionally, each nitrogen-containing heterocyclic ring may be fused to one or more other rings, which may be aromatic, heteroaromatic, carbocyclic, heterocyclic, saturated or unsaturated. Such suitable other rings include, but are not limited to, phenyl, naphthyl, cyclohexyl, cyclopentyl, furyl, thiophenyl, morpholinyl, piperidinyl, and the like. Such compounds may optionally be substituted with one or more of: alkyl, aryl, amino, aminoalkyl, hydroxyl, halo, carboxyl, carboxy alkyl, alkoxy, and the like. As used herein, the term "alkyl" includes linear, branched and cyclic alkyl, and the term "aryl" includes aromatic hydrocarbons and aromatic heterocycles. Preferred mercapto-substituted nitrogen-containing heterocyclic ring compounds are mercapto-substituted triazoles, mercapto-substituted benzotriazoles, and mercapto-substituted tetrazoles.

The mercapto-substituted nitrogen-containing heterocyclic ring compounds useful in the present invention typically have a molecular weight in the range of 95 to 500, preferably from 95 to 450, more preferably from 98 to 400, and yet more preferably from 98 to 275 amu. These compounds also typically have a water solubility of ≥20 g/L in DI water with 1 volume % of methanesulfonic acid at room temperature (approximately 20° C.).

Preferred mercapto-substituted nitrogen-containing heterocyclic ring compounds are those having the following structure (I):

(I)

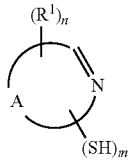

wherein A represents a moiety that forms a 5- to 6-membered heterocyclic ring; each $R^1$ is independently chosen from $(C_1-C_{12})$alkyl, substituted $(C_1-C_{12})$alkyl, $(C_6-C_{15})$aryl, substituted $(C_6-C_{15})$aryl, $(C_7-C_{20})$aralkyl, substituted $(C_7-C_{20})$aralkyl, $NR^2R^3$, —S—$R^4$, hydroxy, $(C_1-C_{12})$alkoxy, and $COR^5$; each of $R^2$ and $R^3$ is independently chosen from H, $(C_1-C_{12})$alkyl, and $(C_6-C_{15})$aryl; $R^4$ is chosen from $(C_1-C_{12})$alkyl, substituted $(C_1-C_{12})$alkyl, $(C_6-C_{15})$aryl, and substituted $(C_6-C_{15})$aryl; $R^5$ is chosen from $(CH_2)_xNR^2R^3$, $R^2$ and $OR^2$; m=1-5; n=0-4; x=0-6; wherein $R^2$ and $R^3$ may be taken together to form a 5- to 6-membered heterocyclic ring; and wherein two or more $R^1$ groups may be joined to form a fused or spirocyclic 5- to 6-membered ring, which may be saturated, unsaturated or aromatic. It is preferred that m=1-3, more preferably 1-2, and most preferably 1. Compounds of formula (I) where n=0-3 are preferred, and more preferred are those where n=0-2. Preferably, A represents a moiety that forms a ring that contains 2 to 4 nitrogens, and more preferably 3 to 4 nitrogens. It is further preferred that A represents a moiety that forms a tetrazole or a triazole ring. Each $R^1$ is preferably independently chosen from $(C_1-C_{12})$alkyl, substituted $(C_1-C_{12})$alkyl, $(C_6-C_{15})$aryl, substituted $(C_6-C_{15})$aryl, $NR^2R^3$, hydroxy, $(C_1-C_{12})$alkoxy, and $COR^5$; and more preferably $(C_1-C_{12})$alkyl, substituted $(C_1-C_{12})$alkyl, $NR^2R^3$, hydroxy, and $COR^5$. Preferably, each of $R^2$ and $R^3$ is independently chosen from H, and $(C_1-C_{12})$alkyl; and more preferably from H, and $(C_1-C_6)$alkyl. $R^4$ is preferably chosen from $(C_1-C_6)$alkyl, substituted $(C_1-C_6)$alkyl, $(C_6-C_{12})$aryl, and substituted $(C_6-C_{12})$aryl; and more preferably from $(C_1-C_6)$alkyl, $(C_6-C_{12})$aryl, and substituted $(C_6-C_{12})$aryl. It is preferred that $R^5$ is chosen from $(CH_2)_xNR^2R^3$, $(C_1-C_{12})$alkyl, $(C_6-C_{15})$aryl, and $OR^2$; wherein x=0-6, and more preferably $(C_1-C_{12})$alkyl, $(C_6-C_{15})$aryl, and $OR^2$. As used herein, "substituted $(C_1-C_{12})$alkyl" means that one or more hydrogens on the alkyl group are replaced with one or more substituents chosen from $(CH_2)_xNR^2R^3$, hydroxy, $(C_1-C_6)$alkoxy, and $COR^5$; where x=0-6. Likewise, "substituted $(C_6-C_{15})$aryl" means that one or more hydrogens on the aryl group are replaced with one or more substituents chosen from $(CH_2)_xNR^2R^3$, hydroxy, $(C_1-C_6)$alkoxy, and $COR^5$; where x=0-6. Similarly, "substituted $(C_7-C_{20})$aralkyl" means that one or more hydrogens on the aralkyl group are replaced with one or more substituents chosen from $(CH_2)_xNR^2R^3$, hydroxy, $(C_1-C_6)$alkoxy, and $COR^5$; where x=0-6.

Exemplary mercapto-substituted nitrogen-containing heterocyclic ring compounds include: 6-mercaptopurine; 4-mercapto-1H-pyrazolo[3,4-d]pyrimidine; 2-mercaptopyridine; 2-mercaptopyrimidine; 4,6-dihydroxy-2-mercaptopyrimidine; 2-mercaptobenzimidazole; 2-mercaptobenzothiazole; 2-mercaptoimidazole; 2-mercapto-5-methylbenzimidazole; 2-mercapto-1-methylimidazole; 5-mercapto-1-methyltetrazole; 1-(2-dimethylaminoethyl)-5-mercapto-1,2,3,4-tetrazole; 2-mercapto-5-methyl-1,3,4-thiadiazole; 2-mercapto-4-methyl-5-thiazolacetic acid; 3-mercapto-4-methyl-4H-1,2,4-triazole; 3-mercapto-1H-1,2,4-triazole; 5-mercapto-3-amino-1,2,4-triazole; 3-mercapto-5-phenyl-1H-1,2,4-triazole; 2-mercaptonicitinic acid; and 6-mercaptonicotinic acid. Preferred mercapto-substituted nitrogen-containing heterocyclic ring compounds are 5-mercapto-1-methyltetrazole; 1-(2-dimethylaminoethyl)-5-mercapto-1,2,3,4-tetrazole; 3-mercapto-4-methyl-4H-1,2,4-triazole; 3-mercapto-1H-1,2,4-triazole; 5-mercapto-3-amino-1,2,4-triazole; and 3-mercapto-5-phenyl-1H-1,2,4-triazole.

All of the above mercapto-substituted nitrogen-containing heterocyclic ring compounds also include their salts, where one or more of the thiol hydrogens is replaced with ammonium or an alkali or alkaline earth metal. Preferably, such in salts one or more of the thiol hydrogens is replaced with lithium, sodium or potassium.

Preferred mercapto-substituted nitrogen-containing heterocyclic ring compounds are triazoles of the formula:

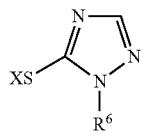

wherein $R^6$ is hydrogen, $(C_1-C_{12})$ alkyl, substituted $(C_1-C_{12})$ alkyl, $(C_7-C_{20})$aralkyl, substituted $(C_7-C_{20})$aralkyl, $(C_6-C_{15})$ aryl or substituted $(C_6-C_{15})$aryl; and X is hydrogen, ammonium, an alkali metal or an alkaline earth metal. Preferably, $R^6$ is hydrogen, $(C_1-C_4)$alkyl, and X is hydrogen, sodium or potassium. More preferably, $R^6$ is hydrogen, methyl or ethyl, and X is hydrogen or sodium; and even more preferably X is hydrogen.

Preferred mercapto-substituted nitrogen-containing heterocyclic ring compounds are tetrazoles of the formula:

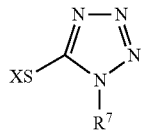

wherein $R^7$ is hydrogen, $(C_1-C_{12})$ alkyl, substituted $(C_1-C_{12})$ alkyl, $(C_7-C_{20})$aralkyl, substituted $(C_7-C_{20})$aralkyl, $(C_6-C_{15})$ aryl or substituted $(C_6-C_{15})$aryl; and X is hydrogen, ammonium, an alkali metal or an alkaline earth metal. Preferably, $R^7$ is hydrogen, $(C_1-C_4)$alkyl, and X is hydrogen, sodium or potassium. More preferably, $R^7$ is hydrogen, methyl or ethyl, and X is hydrogen or sodium; and even more preferably X is hydrogen.

The mercapto-substituted nitrogen-containing heterocyclic ring compounds are generally commercially available, such as from Sigma-Aldrich Corp. (St. Louis, Mo., USA), or may be prepared by methods well-known in the literature. Such compounds may be used without further purification or may be further purified prior to use. The mercapto-substituted nitrogen-containing heterocyclic ring compounds may be used in the present electroplating baths in a variety of amounts, such as from 0.01 to 25 g/L, preferably from 0.5 to 25 g/L, more preferably from 0.5 to 20 g/L, yet more preferably from 0.5 to 15 g/L; and still more preferably from 0.5 to 10 g/L.

When lustrous surfaces are desired, brighteners may be employed. Suitable brighteners include, but are not limited to, aldehydes, ketones, carboxylic acids, carboxylic acid derivatives, amines or mixtures thereof. Specific examples of suitable brighteners may be found in U.S. Pat. Nos. 4,582,576 and 4,246,077. Such brighteners may be employed in amounts of 50 mg/L (milligrams/liter) to 5 g/L of plating bath, typically from 100 mg/L to 250 mg/L. Compounds of iron, cobalt, nickel, zinc, gallium, arsenic, selenium, palladium, cadmium, indium, antimony, tellurium, thallium, lead and bismuth also are suitable. Polyethylene glycols and their derivatives, such as polyethyleneglycol ethers, to the extent that they are water-soluble also are suitable brighteners. Polyethylene glycols and their derivatives may be employed as the only brighteners or they may be employed with the other brighteners disclosed above.

Antioxidants may be added to the present composition to assist in keeping the tin in a soluble, divalent state. Suitable antioxidants include, but are not limited to, hydroquinone and hydroxylated aromatic compounds, such as resorcinol, catechol, and the like, including sulfonic acids derivatives of such aromatic compounds. Such antioxidants are disclosed in U.S. Pat. No. 4,871,429. Other suitable antioxidants or reducing agents include, but are not limited to, vanadium compounds, such as vanadylacetylacetonate, vanadium triacetylacetonate, vanadium halides, vanadium oxyhalides, vanadium alkoxides and vanadyl alkoxides. The amount of such reducing agent is well known to those skilled in the art, but is typically in the range of from 0.1 g/L to 5 g/L.

In addition to the alkoxylated amine oxide surfactants, one or more secondary surfactants may optionally be used in the present electroplating baths. Such secondary surfactants include, but are not limited to, nonionic surfactants, anionic surfactants, amphoteric surfactants and cationic surfactants. Preferably, the optional secondary surfactant is chosen from one or more of nonionic surfactants, anionic surfactants, and amphoteric surfactants. Suitable nonionic surfactants include those in which 2-300 moles of ethylene oxide (EO) and/or propylene oxide (PO) are condensed with any of the following: $(C_1-C_{20})$alkanols, phenols, naphthols, bisphenols, $(C_1-C_{25})$alkylphenols, arylalkylphenols, $(C_1-C_{25})$alkylnaphthols, $(C_1-C_{25})$alkoxylated phosphoric acids (salt), sorbitan esters, styrenated phenols, polyalkyleneglycols, $(C_1-C_{22})$aliphatic amines, $(C_1-C_{22})$aliphatic amides; or $(C_1-C_{25})$alkoxylated phosphoric acids (salts), and the like.

Grain refiners are optionally used in the present tin-silver electroplating baths, and preferably one or more grain refiners are used. A variety of grain refiners are known in tin electroplating, and any of such grain refiners may be suitably used in the present invention. Such compounds provide good grain structure to the tin alloy deposits and at the same time provide a uniform mushroom morphology to tin alloy interconnect bumps (solder bumps) deposited from the compositions. Preferably, the grain refiner is a flavone compound. Such flavone compounds include, but are not limited to, chrysin, fisetin, myricetin, rutin, and pentahydroxy flavones such as morin and quercitrin. Suitable flavones compounds are those disclosed in U.S. Pat. No. 7,968,444. The flavone compounds may be present in an amount of from 1 to 200 mg/L, preferably from 10 to 100 mg/L, and more preferably from 25 to 85 mg/L.

Optionally, one or more grain refiner/stabilizer compounds may optionally be included in the compositions to further improve the electroplating operating window. It is preferred that one or more grain refiner/stabilizer compounds be present in the compositions of the invention. Such grain refiner/stabilizer compounds include, but are not limited to: hydroxylated gamma-pyrones such as maltol, ethylmaltol, kojic acid, meconic acid, and comenic acid; hydroxylated benzoquinones such as chloranilic acid and dihydroxybenzoquinone; hydroxylated naphthols such as chromotropic acid; anthraquinone; hydroxylated pyridines; cyclopentandiones; hydroxy-furanones; hydroxy-pyrrolidones; and cyclohexanediones. Such compounds may be included in the compositions in amounts of 2 to 10,000 mg/L, and preferably from 50 to 2000 mg/L.

Conductivity acids and their salts also may be employed the present compositions and include, but are not limited to, boric acid, carboxylic acids, hydroxy acids, and salts of these acids to the extent they are water-soluble. Preferred are formic acid, acetic acid, oxalic acid, citric acid, malic acid, tartaric acid, gluconic acid, glucaric acid, glucuronic acid, and salts of these acids. Such conductivity acids and salts are employed in conventional amounts.

Water-soluble salts of one or more other alloying metals may optionally be added to the present electroplating baths when a ternary or quaternary tin-silver alloy is desired. Examples of other alloying metals include, without limitation, copper, indium, zinc, bismuth, manganese and antimony. The choice of such other alloying metals and their water-soluble salts are within the ability of those skilled in the art. Conventional amounts of such water-soluble salts may be used.

Electroplating baths of the present invention are prepared by combining the following: a water-soluble source of divalent tin ions; a water-soluble source of silver ions; acid electrolyte; an alkoxylated amine oxide surfactant, and any of the following optional components: a mercapto-substituted nitrogen-containing heterocyclic ring compound, brighteners, antioxidants, additional surfactants, grain refiners, conductivity acids and their salts, water-soluble salts of other alloying metals, and mixtures thereof, with the balance of the composition being water. Such components may be combined in any order. The water used is preferably DI water. The amount of each of the above components can be adjusted and selected as appropriate depending on the particular application. Once the composition is prepared, undesired material can be removed, such as by filtration, and then additional water is typically added to adjust the final volume of the composition. The composition may be agitated by any known means, such as stirring, pumping, or recirculating, for increased plating speed. The present tin-silver alloy electroplating compositions are acidic, that is, they have a pH of less than 7. Typically, the present electroplating compositions have a pH of from 0 to less than 7, preferably from 0 to ≤5, more preferably from 0 to ≤2, and yet more preferably from 0 to ≤1.

Preferably, the present electroplating baths are substantially free of one or more of cyanide ions, organic solvent, disulfide compounds, and dithiocarbamic acids. More preferably, the present compositions are free of one or more of cyanide ions, and dithiocarbamic acids. The term "substantially free" means that the compositions contain less than 1 wt % of that component, and preferably less than 0.5 wt % of that component.

The present electroplating compositions are suitable for depositing a metal alloy layer comprising tin-silver, where the tin and silver may be present in various amounts. Such metal alloy layers include, without limitation, tin-silver, tin-silver-copper, tin-silver-copper-antimony, tin-silver-copper-manganese, tin-silver-bismuth, tin-silver-indium, tin-silver-zinc-copper, and tin-silver-indium-bismuth. Preferably, the present electroplating compositions deposit an alloy of tin-silver or tin-silver-copper, and preferably tin-silver. Alloys deposited from the present electroplating bath contain an amount of tin ranging from 0.01 to 99.99 wt %, and an amount of silver ranging from 99.99 to 0.01 wt %, based on the weight of the alloy, as measured by either atomic adsorption spectroscopy (AAS), X-ray fluorescence (XRF), inductively coupled plasma (ICP) or differential scanning calorimetry (DSC). Preferably, the tin-silver alloys deposited using the present invention contain from 75 to 99.99 wt % tin and 0.01 to 10 wt % of silver and any other alloying metal. More preferably, the tin-silver alloy deposits contain from 95 to 99.9 wt % tin and 0.1 to 5 wt % of silver and any other alloying metal. Tin-silver alloy is the preferred deposit, and preferably contains from 90 to 99.9 wt % tin and from 10 to 0.1 wt % silver. More preferably, the tin-silver alloy deposits contain from 95 to 99.9 wt % tin and from 5 to 0.1 wt % silver. For many applications, the eutectic composition of an alloy may be used. Alloys deposited according to the present invention are substantially free of lead, that is, they contain ≤1 wt % lead, more preferably ≤0.5 wt %, and yet more preferably ≤0.2 wt %, and still more preferably are free of lead.

The electrolyte compositions of the present invention are useful in various plating methods where a tin-silver alloy is desired and the use of a low-foaming electroplating bath is desired. Plating methods include, but are not limited to, horizontal or vertical wafer plating, barrel plating, rack plating, high speed plating such as reel-to-reel and jet plating, and rackless plating. A tin-silver alloy may be deposited on a substrate by the steps of contacting the substrate with the above electrolyte composition and passing a current through the electrolyte to deposit the tin-silver alloy on the substrate. Substrates which may be plated include, but are not limited to, copper, copper alloys, nickel, nickel alloys, nickel-iron containing materials, electronic components, plastics, and semiconductor wafers such as silicon or gallium-arsenide wafers. Plastics which may be plated include, without limitation, plastic laminates, such as printing wiring boards, particularly copper clad printed wiring boards. The electrolyte compositions may be used for electroplating of electronic components, such as lead frames, semiconductor wafers, semiconductor packages, components, connectors, contacts, chip capacitors, chip resistors, printed wiring boards, and wafer interconnect bump plating applications. The substrate may be contacted with the electrolyte composition in any manner known in the art. Typically, the substrate is placed in a bath containing the electrolyte composition.

The particular current density used to plate the tin-silver alloy depends on the particular plating method. Generally, the current density is ≥1 A/dm$^2$, such as from 1 to 200 A/dm$^2$, preferably from 2 to 30 A/dm$^2$, more preferably from 2 to 20 A/dm$^2$, even more preferably from 5 to 20 A/dm$^2$, and yet more preferably from 8 to 20 A/dm$^2$.

Tin-silver alloys may be deposited at a temperature of 15° C. or higher, preferably in the range of from 15° to 66° C., and more preferably from 20° to 55° C. In general, the longer the time the substrate is plated the thicker the deposit while the shorter the time the thinner the deposit for a given temperature and current density. Thus, the length of time a substrate remains in a plating composition may be used to control the thickness of the resulting tin-silver alloy deposit. In general, metal deposition rates may be as high as 15 μm/min. Typically, deposition rates may range from 1 to 10 μm/min, and preferably from 3 to 8 μm/min.

While the present electrolyte compositions may be used for a variety of applications as described above, an exemplary application of tin-silver alloy compositions is for interconnect bump (solder bump) formation for wafer-level-packaging. This method involves providing a semiconductor die (wafer die) having a plurality of interconnect bump pads, forming a seed layer over the interconnect bump pads, depositing a tin-silver alloy interconnect bump layer over the interconnect bump pads by contacting the semiconductor die with the present electroplating composition and passing a current through the electroplating composition to deposit the tin-silver alloy interconnect bump layer on the substrate, and then reflowing the interconnect bump layer to form a solder bump.

In general, a device includes a semiconductor substrate on which is formed a plurality of conductive interconnect bump pads. The semiconductor substrate may be a single-crystal silicon wafer, a silicon-germanium substrate, a gallium-arsenide substrate, a silicon-on-sapphire (SOS) substrate, or a silicon-on-insulator (SOI) substrate. The conductive interconnect bump pad may be one or more layers of a metal, composite metal or metal alloy typically formed by physical vapor deposition (PVD) such as sputtering. Typical conductive interconnect bump pad materials include, without limitation, aluminum, copper, titanium nitride, and alloys thereof.

A passivation layer is formed over the interconnect bump pads and openings extending to the interconnect bump pads are formed therein by an etching process, typically by dry etching. The passivation layer is typically an insulating material, for example, silicon nitride, silicon oxynitride, or a silicon oxide, such as phosphosilicate glass (PSG). Such materials may be deposited by chemical vapor deposition (CVD) processes, such as plasma enhanced CVD (PECVD).

An under bump metallization (UBM) structure formed typically of a plurality of metal or metal alloy layers, is deposited over the device. The UBM acts as an adhesive layer and electrical contact base (seed layer) for an interconnect bump to be formed. The layers forming the UBM structure may be deposited by PVD, such as sputtering or evaporation, or CVD processes. Without limitations, the UBM structure may be, for example, a composite structure including in order, a bottom chrome layer, a copper layer, and an upper tin layer.

A photoresist layer is applied to the device, followed by standard photolithographic exposure and development techniques to form a patterned photoresist layer (or plating mask) having openings or vias therein (plating vias). The dimensions of the plating mask (thickness of the plating mask and the size of the openings in the pattern) defines the size and location of the tin-silver layer deposited over the I/O pad and UBM. The diameters of such deposits typically range from 5 to 300 μm, preferably from 10 to 150 μm. The height of such deposits typically range from 10 to 150 μm, preferably from 15 to 150 μm, and more preferably from 20 to 80 μm. Suitable photoresist materials are commercially available (such as from Dow Electronic Materials, Marlborough, Mass., USA) and are well-known in the art.

The interconnect bump material is deposited on the device by an electroplating process using the above-described electroplating compositions. Interconnect bump materials include, for example, any suitable tin-silver alloys. Such alloys may have compositions such as described above. It may be desired to use such compositions at their eutectic concentrations. The bump material is electrodeposited in the areas defined by the plating via. For this purpose, a horizontal or vertical wafer plating system, for example, a fountain plating system, is typically used with a direct current (DC) or pulse-plating technique. In the plating process the interconnect bump material completely fills the via extending above and on a portion of the top surface of the plating mask, resulting in a mushroom-shaped metal deposit. This ensures that a sufficient volume of interconnect bump material is deposited to achieve the desired ball size after reflow. In the in via plating process, the photoresist thickness is sufficiently thick such that the appropriate volume of interconnect bump material is contained within the plating mask via. A layer of copper or nickel may be electrodeposited in the plating via prior to plating the interconnect bump material. Such a layer may act as a wettable foundation to the interconnect bump upon reflow.

Following deposition of the interconnect bump material the plating mask is stripped using an appropriate solvent or other remover. Such removers are well known in the art. The UBM structure is then selectively etched using known techniques, removing all metal from the field area around and between interconnect bumps.

The wafer is then optionally fluxed and is heated in a reflow oven to a temperature at which the interconnect bump material melts and flows into a truncated substantially spherical shape. Heating techniques are known in the art, and include, for example, infrared, conduction, and convection techniques, and combinations thereof. The reflowed interconnect bump is generally coextensive with the edges of the UBM structure. The heat treatment step may be conducted in an inert gas atmosphere or in air, with the particular process temperature and time being dependent upon the particular composition of the interconnect bump material.

Alternatively, the present electroplating compositions may be used to deposit a tin-silver alloy capping layer on a solder deposit. For example, a tin-silver alloy may be deposited on top of a copper pillar, such as that used in the manufacture of flip-chip interconnects. When used as a capping layer on a copper pillar, the total height of such capped copper pillar may range from 20 to 50 μm, and may have a diameter of from 30 to 45 μm. In a further alternative, such capped solder deposits may contain a plurality of capping layers. Other suitable capping layers that may be used with the present tin-silver alloy deposits include: pure tin and tin-alloys such as tin-bismuth and tin-copper. Where a plurality of capping layers are used, the tin-silver alloy layer is typically the topmost layer.

EXAMPLE 1

A conventional tin-silver electroplating bath (Comparative 1) was prepared based on Example 5 of U.S. Pat. No. 7,968,444, by combining 75 g/L tin from tin methanesulfonate, 0.4 g/L silver from silver methanesulfonate, 275 mL/L 70% methanesulfonic acid, 2.7 g/L 3,6-dithia-1,8-octanediol, 1 g/L ethyl maltol, 4 g/L ethoxylated bisphenol A (13 ethylene oxide units) as surfactant, 50 mg/L pentahydroxy flavone, 1 g/L hydroquinone monosulfonic acid potassium salt, and DI water (balance).

A second tin-silver electroplating bath (Comparative 2) was prepared in the same manner Comparative 1, except that the surfactant was replaced with another common surfactant used in tin and tin-alloy electroplating, an EO/PO/EO copolymer having 30% EO groups, 70% PO groups and an average molecular weight of 1850 (Pluronic L43).

A tin-silver electroplating bath of the invention (Sample 1) was prepared in the same manner as Comparative 1, except that the surfactant was replaced with an alkoxylated amine oxide surfactant of the formula

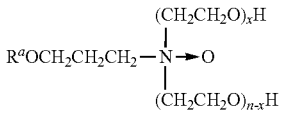

where $R^a$ is a $(C_9\text{-}C_{11})$alkyl.

Tin-Silver (SnAg) Wafer Bumping Test:

SnAg solder bumps were electroplated on a 200 mm patterned silicon wafer using each of the Comparative 1, Comparative 2, and Sample 1 electroplating baths in a NeXX plating tool. The patterned wafers had 75 μm diameter vias and 3 different pitch sizes (150, 225 and 375 μm), a platable area of 3-20%, a negative dry film resist height of 75 μm, and a seed of 1 kÅ Ti/3 kÅ Cu. Copper studs with 5 um in height are used as UBM layer to enhance adhesion between SnAg solder bumps and the wafer. The wafers were plated vertically with rapid oscillation. Platinized titanium was used as an insoluble anode and current densities from 12 to 20 $A/dm^2$ were used.

The height of 11 bumps was measured on each wafer using a profilometer (KLA Tencor) to obtain within-die (WID) uniformity (or coplanarity) which was calculated by equation 1:

$$\text{Coplanarity}(\%) = \frac{h_{max} - h_{min}}{2h_{avg}} \times 100 \quad (1)$$

where $h_{max}$ is the height of the highest SnAg bump in a die, $h_{min}$ is the height of the shortest SnAg bump in a die, and $h_{avg}$ is the average height of SnAg solder bumps. The smaller the coplanarity value (or within-die uniformity), the more uniform the SnAg solder bumps. Uniformity of solder bumps is critical to ensuring proper attachment of components to the wafer.

Tin-silver layers were deposited on the wafers using each of the three electroplating baths prepared above. The results of the analysis of the resulting solder bumps is shown in the following table.

| | Comparative 1 | Comparative 2 | Sample 1 |
|---|---|---|---|
| Average bump height (μm) | 74.1 | 73.7 | 65.4 |
| Range of bump heights ($h_{max} - h_{min}$) (μm) | 16.2 | 13.1 | 4.5 |
| Co-planarity % (within-die uniformity) | 10.91 | 8.89 | 3.44 |

As can be seen from the data, Sample 1, which used an alkoxylated amine oxide surfactant, showed significantly more uniform tin-silver solder bumps (smaller % coplanarity value) than those obtained from electroplating baths using convention nonionic surfactants.

EXAMPLE 2

A series of electroplating baths were prepared by combining 75 g/L tin methanesulfonate, 275 mL/L methanesulfonic acid, 0.7 g/L silver methanesulfonate, 1.5 g/L 4-methyl-1,2,4-triazole-3-thiol (mercapto-substituted nitrogen-containing heterocyclic ring compound), 5 g/L surfactant, 10 mL/L pentahydroxy flavone, 1 g/L 2,5-dihydroxybenzene sulfonic acid potassium salt (antioxidant) and water (balance). The surfactant used in each electroplating bath is reported below.

| Electroplating Bath | Surfactant |
|---|---|
| Sample 2 (Invention) | alkoxylated amine oxide surfactant used in Sample 1 from Example 1 |
| Comparative 3 | ethoxylated bisphenol A (13 ethylene oxide units) surfactant in Comparative 1 from Example 1 |
| Comparative 4 | β-naphthol ethyleneoxide derivative |
| Comparative 5 | EO/PO/EO copolymer having 20% EO groups, 80% PO groups and an average molecular weight of 2000 (Pluronic L61) |
| Comparative 6 | EO/PO block copolymer derived ethylenediamine having 10% EO groups and 90% PO groups and an average molecular weight of 3600 (Tetronic 701) |

Each of these electroplating baths was used to deposit a tin-silver solder on a 200 mm wafer according to the process of Example 1. The resulting deposits were evaluated for within-die uniformity (coplanarity) as described in Example 1. The resulting tin-silver deposits were also evaluated by cross-sectional analysis to determine the presence of voids, which are detrimental to the integrity of the solder joint. The data are reported in the following table.

| | Average Bump Height (μm) | Co-planarity (%) | Voids Present |
|---|---|---|---|
| Sample 2 | 56 | 20 | No |
| Comparative 3 | 58 | 40 | No |
| Comparative 4 | 49 | 22 | Yes |
| Comparative 5 | 53 | 19 | Yes |
| Comparative 6 | 59 | 46 | Yes |

The above data clearly show that only the tin-silver electroplating bath containing the alkoxylated amine oxide surfactant provided void-fee solder deposits with better within-die uniformity than conventional electroplating surfactants.

EXAMPLE 3

An electroplating bath (Sample 3) was prepared by combining 75 g/L tin methanesulfonate, 275 mL/L methanesulfonic acid, 0.7 g/L silver methanesulfonate, 1.5 g/L 1-(2-dimethylaminoethyl)-5-mercapto-1,2,3,4-tetrazole (mercapto-substituted nitrogen-containing heterocyclic ring compound), 20 g/L alkoxylated amine oxide surfactant used in Sample 1 (from Example 1), 10 mL/L pentahydroxy flavone, 1 g/L 2,5-dihydroxybenzene sulfonic acid potassium salt (antioxidant), and water (balance).

This electroplating baths was used to deposit a tin-silver solder on a 200 mm wafer according to the process of Example 1. The resulting deposits were evaluated for within-die uniformity (coplanarity) as described in Example 1, and were found to have better within-die uniformity than deposits obtained from Comparative 3 electroplating bath.

EXAMPLE 4

The procedure of Example 3 is repeated using the following electroplating bath (Sample 4): 70 g/L tin methanesulfonate, 255 mL/L methanesulfonic acid, 0.8 g/L silver methanesulfonate, 1.2 g/L 1H-1,2,4-triazole-3-thiol (mercapto-substituted nitrogen-containing heterocyclic ring compound), 10 g/L alkoxylated amine oxide surfactant used in Sample 1 (from Example 1), 10 mL/L pentahydroxy flavone, 1 g/L 2,5-dihydroxybenzene sulfonic acid potassium salt (antioxidant), and water (balance).

EXAMPLE 5

The procedure of Example 3 is repeated using the following electroplating bath (Sample 5): 75 g/L tin methanesulfonate, 275 mL/L methanesulfonic acid, 0.65 g/L silver methanesulfonate, 2.5 g/L 1H-1,2,4-triazole-3-thiol (mercapto-substituted nitrogen-containing heterocyclic ring compound), 15 g/L bis-(2-hydroxyethyl)-isodecyloxypropylamine oxide surfactant (Tomamine AO-14-2), 12 mL/L pentahydroxy flavone, 1 g/L 2,5-dihydroxybenzene sulfonic acid potassium salt (antioxidant), and water (balance).

EXAMPLE 6

The procedure of Example 3 is repeated using the following electroplating bath (Sample 6): 75 g/L tin methanesulfonate, 325 mL/L methanesulfonic acid, 0.6 g/L silver methanesulfonate, 3.0 g/L 5-phenyl-1H-1,2,4-triazole-3-thiol (mercapto-substituted nitrogen-containing heterocyclic ring compound), 10 g/L alkoxylated amine oxide surfactant (Tomamine AO-405), 5 mL/L gallic acid, 1 g/L 2,5-dihydroxybenzene sulfonic acid potassium salt (antioxidant), and water (balance).

EXAMPLE 7

An electroplating bath (Sample 7) was prepared by combining 75 g/L tin methanesulfonate, 125 mL/L methanesulfonic acid, 0.7 g/L silver methanesulfonate, 2.2 g/L 4-methyl-1,2,4-triazole-3-thiol (mercapto-substituted nitrogen-containing heterocyclic ring compound), 20 g/L alkoxylated amine oxide surfactant used in Sample 1 (from Example 1), 10 mL/L pentahydroxy flavone, 1 g/L 2,5-dihydroxybenzene sulfonic acid potassium salt (antioxidant), and water (balance).

Sample 7 electroplating bath was subjected to the SnAg wafer bumping test of Example 1, along with the Comparative 1 electroplating bath. Wafers were plated using each of the Sample 7 and Comparative 1 baths at 12 A/dm$^2$. The height of 11 bumps within 9 dies on each wafer were measured. Within-die uniformity on each wafer was calculated according to the procedure of Example 1, and is reported below.

| Within-die Uniformity | | | | | | | | | | |
|---|---|---|---|---|---|---|---|---|---|---|
| | | Die location | | | | | | | | |
| Sample | | 1 | 2 | 3 | 4 | 5 | 6 | 7 | 8 | 9 |
| Sample 7 | Average height (μm) | 51.8 | 52.4 | 54.9 | 56.0 | 56.9 | 56.7 | 56.1 | 57.9 | 59.3 |
| | Co-planarity (%) | 6.6 | 3.5 | 4.9 | 7.5 | 7.6 | 7.6 | 8.2 | 7.2 | 6.6 |
| Comparative 1 | Average height (μm) | 53.4 | 56.2 | 55.1 | 57.4 | 59.3 | 58.7 | 57.3 | 60.2 | 60.4 |
| | Co-planarity (%) | 25.9 | 25.0 | 30.8 | 27.3 | 26.1 | 27.4 | 29.0 | 30.7 | 25.9 |

As can be seen in the above table, each die plated with the Sample 7 electroplating bath had significantly better within-die uniformity than those dies plated with the Comparative 1 electroplating bath.

Within-wafer uniformity was calculated by including the heights of the bumps in the 9 dies on the wafer. The results are shown below.

| Within-wafer Uniformity | | |
|---|---|---|
| | Sample 7 | Comparative 1 |
| Average height (μm) | 55.7 | 57.8 |
| Range of height (μm) | 14.9 | 40.4 |
| Co-planarity (%) | 13.4 | 34.9 |

As can be seen in the above table, the wafer plated with the Sample 7 electroplating bath had significantly better within-wafer uniformity than the wafer plated with the Comparative 1 electroplating bath.

EXAMPLE 8

A series of tin-silver electroplating baths were prepared by combining 75 g/L tin methanesulfonate, 125 mL/L methanesulfonic acid, 0.6 g/L silver methanesulfonate, 5 g/L alkoxylated amine oxide surfactant used in Sample 1 (from Example 1), 12 mL/L pentahydroxy flavone, 1 g/L 2,5-dihydroxybenzene sulfonic acid potassium salt (antioxidant), and water (balance). Each electroplating bath also contained a different amount of 4-methyl-1,2,4-triazole-3-thiol ("MTT") (mercapto-substituted nitrogen-containing heterocyclic ring compound), based on a molar ratio to silver. The molar ratios of Ag:MTT for each of Samples 8-12 is reported below.

| Sample | Ag:MTT (molar ratio) |
|---|---|
| 8 | 1.5:1 |
| 9 | 2:1 |
| 10 | 2.5:1 |
| 11 | 3:1 |
| 12 | 4:1 |

Wafers were electroplated with each of Samples 8-12 and Comparative 1, according to the general procedures of Example 1. The wafers plated from each of Samples 8-12 showed a 70% improvement of within-die uniformity (70% lower) as compared to Comparative 1, with the Samples 9 and 11 showing the best (lowest percentage) within-die uniformity.

What is claimed is:

1. An electroplating composition comprising: a water-soluble source of divalent tin ions; a water-soluble source of silver ions; water; acid electrolyte; and an alkoxylated amine oxide surfactant having the formula

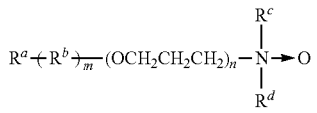

wherein $R^a$ is selected from a ($C_6$-$C_{22}$)alkyl group and a substituted ($C_7$-$C_{22}$)aryl group; $R^b$ is an alkoxylated unit; m is 0 to 7 and represents the number of moles of $R^b$; n is 0 or 1; and $R^c$ and $R^d$ are each at least one alkoxylated unit and the total number of alkoxylated units preresent in $R^c$ and $R^d$ is from 3 to 30.

2. The composition of in claim 1 wherein the alkoxylated unit is chosen from ethyleneoxy, propyleneoxy, butyleneoxy, and mixtures thereof.

3. The composition of claim 1 wherein $R^c$ and $R^d$ are each chosen from ethyleneoxy units, propyleneoxy units, and mixtures thereof.

4. The composition of claim 1 wherein m=0.

5. The composition of claim 1 further comprising a mercapto-substituted nitrogen-containing heterocyclic ring compound.

6. The composition of claim 5 wherein the mercapto-substituted nitrogen-containing heterocyclic ring compound comprises a nitrogen-containing heterocyclic ring chosen from: pyridine, pyrrole, imidazole, benzimidazole, purine, thiazoline, tetrazole, triazole, thiadiazole, and pyrimidine.

7. The composition of claim 5 wherein the mercapto-substituted nitrogen-containing heterocyclic ring compound has the following structure (I):

(I)

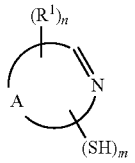

wherein A represents a moiety that forms a 5- to 6-membered heterocyclic ring; each $R^1$ is independently chosen from $(C_1$-$C_{12})$alkyl, substituted $(C_1$-$C_{12})$alkyl, $(C_6$-$C_{15})$aryl, substituted $(C_6$-$C_{15})$aryl, $(C_7$-$C_{20})$aralkyl, substituted $(C_7$-$C_{20})$aralkyl, $NR^2R^3$, —S—$R^4$, hydroxy, $(C_1$-$C_{12})$alkoxy, and $COR^5$; each of $R^2$ and $R^3$ is independently chosen from H, $(C_1$-$C_{12})$alkyl, and $(C_6$-$C_{15})$aryl; $R^4$ is chosen from $(C_1$-$C_{12})$alkyl, substituted $(C_1$-$C_{12})$alkyl, $(C_6$-$C_{15})$aryl, and substituted $(C_6$-$C_{15})$aryl; $R^5$ is chosen from $(CH_2)_xNR^2R^3$, $R^2$ and $OR^2$; m=1-5; n=0 -4; and x=0-6; wherein $R^2$ and $R^3$ may be taken together to form a 5- to 6-membered heterocyclic ring; and wherein two or more $R^1$ groups may be joined to form a fused or spirocyclic 5- to 6-membered ring, which may be saturated, unsaturated or aromatic.

8. The composition of claim 7 wherein A represents a moiety that forms a tetrazole or a triazole ring.

9. A method of depositing a tin-silver layer comprising: contacting a substrate with the composition of claim 1 and; applying a potential for a period of time to deposit a tin-silver-containing layer on the substrate.

10. The method of claim 9 wherein the substrate is a semiconductor substrate.

11. The method of claim 9 wherein the tin-silver-containing layer is an interconnect bump layer.

12. The method of claim 9 wherein tin-silver-containing layer is substantially free of voids.

* * * * *